US005509170A

United States Patent [19]

LoFaro et al.

[11] Patent Number: 5,509,170

[45] Date of Patent: Apr. 23, 1996

[54] SHOE MAINTENANCE AND STORAGE BOX

[76] Inventors: Domenic LoFaro, 617 Clermont Ave.; Frank Porzio, 217 Sprague Ave., both of Staten Island, N.Y. 10307; Peter Ballack, 20 Grand Blvd., Spotswood, N.J. 08884

[21] Appl. No.: 404,063

[22] Filed: Mar. 14, 1995

[51] Int. Cl.[6] ..... A47L 23/16; A47L 23/14; B65D 85/18

[52] U.S. Cl. ..... 15/265; 15/257.01; 206/292

[58] Field of Search ..... 206/373, 278, 206/292, 295, 296, 315.1, 229; 12/122, 128; 15/265, 257.01, 258, 259, 266, 267

[56] References Cited

U.S. PATENT DOCUMENTS

| | | | |
|---|---|---|---|
| 1,320,392 | 11/1919 | Hirschman . | |
| 1,811,439 | 6/1931 | Scherz et al. . | |
| 1,950,242 | 3/1934 | Hollingshead | 12/128 R |
| 1,968,580 | 7/1934 | Wheary | 206/292 |
| 2,356,029 | 8/1944 | Burger | 15/265 |
| 2,463,141 | 3/1949 | Bohner | 15/265 |
| 2,667,658 | 2/1954 | Cornick . | |
| 2,991,495 | 7/1961 | Blalack | 15/265 |
| 3,063,550 | 11/1962 | Boden et al. . | |
| 3,414,093 | 12/1968 | Chostner | 206/292 X |
| 4,066,156 | 1/1978 | Basile | 206/315.1 X |
| 4,083,483 | 4/1978 | Bayless | 224/45 R |
| 4,131,196 | 12/1978 | Csutor | 206/278 |
| 4,394,042 | 7/1983 | Smith | 294/163 |
| 4,657,135 | 4/1987 | Kjose | 206/315.3 |
| 4,699,267 | 10/1987 | Burke | 206/278 |
| 4,735,319 | 4/1988 | Mead | 15/265 X |
| 4,795,029 | 1/1989 | Campbell et al. | 206/278 |
| 4,819,795 | 4/1989 | Swaney | 206/278 |
| 4,823,426 | 4/1989 | Bragga | 15/210 |
| 4,881,637 | 11/1989 | Peters et al. | 206/278 |
| 5,193,671 | 3/1993 | Patterson | 206/48.14 |
| 5,228,547 | 7/1993 | Yoo | 206/315.1 X |
| 5,269,408 | 12/1993 | Otis et al. | 206/288 |

FOREIGN PATENT DOCUMENTS 14930 10/1901 Sweden .

*Primary Examiner*—Paul T. Sewell
*Assistant Examiner*—Beth Anne C. Dayoan
*Attorney, Agent, or Firm*—Richard C. Litman

[57] ABSTRACT

A portable shoe maintenance and storage box has separable shoe maintenance and shoe storage portions, with the two portions capable of being latched or secured together to close the box. The relatively deeper storage portion provides interior space for holding a pair of shoes therein, and a shelf for holding various shoe maintenance and cleaning articles (e. g., brushes, polish, cleaning cloths or rags, golf shoe spike tool, etc.) therein. The relatively shallower maintenance portion includes a shoe holder which extends beyond the plane defined by the edges of the peripheral walls of the maintenance portion, to provide clearance from the peripheral walls for working on a shoe on the holder. The holder is adapted to hold a shoe either upright or inverted, for cleaning of the upper portion of the shoe, or for work on the sole and heel portions. When the maintenance and storage portions are latched together, a pair of shoes and other articles may be securely stored or carried therein. The box is particularly suitable for golf shoes, but may be used for the maintenance and storage of virtually any type of footwear.

14 Claims, 4 Drawing Sheets

SHOE MAINTENANCE AND STORAGE BOX

FIELD OF THE INVENTION

The present invention relates generally to storage containers, and more specifically to a box providing for the storage of shoes and cleaning and maintenance implements and supplies therefor. The box opens to form a shoe stand providing for the holding of a shoe thereon for cleaning or other maintenance.

BACKGROUND OF THE INVENTION

Various specialized shoes have been developed over the years, adapted to the pursuit of various hobbies or specialized occupations. An example is the bowling shoe, which is generally carried in a common container or bag along with a bowling ball, hand towel, and/or other accessories. Golf is another activity which generally utilizes a specialized shoe, having cleats or spikes on the sole and heel thereof for better traction on natural turf surfaces at golf courses.

The outdoor environment in which golf shoes are normally worn generally results in a need to clean such shoes periodically, and the spikes also require maintenance from time to time. Moreover, due to the spikes, the indoor wear of such shoes is generally prohibited, e.g., in the clubhouse, snack bar, etc. However, the typical golf bag fails to provide any suitable storage area for such shoes, and even if it did, generally there is no accommodation for additional maintenance and cleaning supplies. Moreover, in the event that the carriage of such shoes is desired, one would not wish to also carry a sports equipment bag (bowling, golf, etc.) just in order to carry the shoes.

Accordingly, the need arises for a shoe maintenance and storage box providing for the storage and carriage of a single pair of shoes therein, and also for the storage and carriage of cleaning and maintenance supplies therefor. The box should also provide a support therein and be convertible to provide for the holding of a shoe on the support, for maintenance and cleaning of the shoe.

DESCRIPTION OF THE PRIOR ART

U.S. Pat. No. 1,320,392 issued to William F. Hirschman on Nov. 4, 1919 describes a Shoe Polishing Cabinet adapted for permanent installation in a wall recess or the like, and accordingly, is not portable as is the present invention. The lid is permanently attached, rather than being removable as provided by the present storage and maintenance box. Accordingly, a separate tray must be provided in the Hirschman cabinet for the capture of debris, whereas the entire portable base of the present box may be carried to a trash disposal point to discard such debris. No means is provided by Hirschman to hold a shoe inverted for work on the sole of the shoe, as provided by the present invention.

U.S. Pat. No. 1,811,439 issued to Louis Scherz et al. on Jun. 23, 1931 describes a Lunch Box including a separate removable tray which is enclosed entirely within the box. The present shoe maintenance tray is not a separate part of the box, but rather forms one component of the box. As the Scherz et al. lunch box is not intended for shoe maintenance, no support or holder for the cleaning and maintenance of shoes is provided, nor are any fixed shelves provided for the storage of maintenance and cleaning articles therein.

U.S. Pat. No. 2,667,658 issued to Carrington R. Cornick on Feb. 2, 1954 describes a Combined Stool And Cabinet including a shoe rest therein for the maintenance of shoes.

No storage room for the storage of shoes in Cornick stool/cabinet is disclosed, however; the only storage room comprises a plurality of swing-out shelves for smaller articles. (The shelves are clearly not large enough for shoe storage, when compared to the shoe rest above.) While the shoe rest is vertically adjustable, no means is provided for the inversion of a shoe thereon for maintenance or cleaning of the sole, nor is a removable debris tray provided, as in the present shoe maintenance and storage box.

U.S. Pat. No. 3,063,550 issued to Ogden W. Bowden et al. on Nov. 13, 1962 describes a Shoe Form And Storage Box including means for stretching and maintaining the shape of a pair of shoes stored therein. A linkage is provided from the hinged lid to the shoe trees within the box, which applies stretching force to the insides of the shoes when the box is closed. The present invention, with its separable components, provides a device insertable into the interior of only a single shoe at a time, and then only when the present box is opened for work on the shoes.

U.S. Pat. No. 4,083,483 issued to Norman G. Bayless on Apr. 11, 1978 describes a Shoe Holder comprising two separate containers for the carriage of a pair of shoes therein. The containers are adjustable in size and may be secured together, if desired. No space is provided for the carriage of maintenance and cleaning implements, nor is a shoe tree or stand provided for the support of a shoe for maintenance and/or cleaning, as provided by the present invention.

U.S. Pat. No. 4,131,196 issued to Frank Csutor on Dec. 26, 1978 describes an Ice Skate Carrying Case With Exterior End Wall Skate Support. Channels are provided within the box to accept the skate blades, unlike the present box. As the Csutor box is adapted particularly for ice skates, no central support is provided for the support of the sole of a shoe thereon for maintenance and cleaning thereof. The lid is hinged to the bottom of the box, rather than being removable, as provided by the present storage and maintenance box, and no additional storage is provided for other articles.

U.S. Pat. No. 4,394,042 issued to David H. Smith on Jul. 19, 1983 describes an Ice Skate Carrier providing for the external carriage of ice skates thereon by gripping the blades of the skates. A storage area is included within the carrier, but no separate lid or support is provided for maintenance or cleaning of shoes supported thereon, particularly for work on the sole of the shoe (or blade of the skate).

U.S. Pat. No. 4,657,135 issued to Kenneth L. Kjose on Apr. 14, 1987 describes a Combined Golf Bag And Equipment Carrier comprising a closable container for the carriage and storage of a golf bag, and other articles, therein. The equipment carrier may carry shoes and other articles therewithin in addition to the golf bag, which articles are not carriable within the golf bag itself. However, the Kjose container is relatively large and bulky, as it is adapted for the carriage of a golf bag in addition to shoes and other articles. No support is provided by Kjose for a shoe for cleaning or maintaining the shoe, as provided by the present shoe maintenance and storage box.

U.S. Pat. No. 4,699,267 issued to James A. Burke on Oct. 13, 1987 describes a Portable Shoe Rack For Travelers for the storage and carriage of several pairs of shoes therein. The result is relatively large, heavy and bulky in comparison to the present box, which provides for the carriage and storage of only a single pair of shoes therein. The Burke device does not provide any means for the support of a shoe, either upright or inverted, for cleaning or maintenance thereof, as provided by the present invention.

U.S. Pat. No. 4,795,029 issued to Robert B. Campbell et al. on Jan. 3, 1989 describes a Shoe Display And Storage Device formed of a thin sheet of clear plastic, unlike the present invention. The Campbell et al. device is adapted for the simultaneous storage and display of a new pair of shoes therein, which shoes need no maintenance or cleaning. Accordingly, no provision is made for the support of a shoe during maintenance or cleaning, as provided by the present invention. The lid of the Campbell et al. device is hinged to the lower portion, unlike the present separable box components.

U.S. Pat. No. 4,819,795 issued to John W. Swaney on Apr. 11, 1989 describes a Package For Footwear formed of molded plastic. A groove is provided for at least one vertically disposed removable baffle therein, and the box is shaped to provide nesting of plural such boxes. No support or pedestal is provided for the support of a shoe thereon for cleaning or maintenance, as provided by the present invention, and no shelves or other storage for other articles is provided by the Swaney box. While the lid of the Swaney box is vented, no cross ventilation is provided by Swaney, as provided by the present shoe maintenance and storage box.

U.S. Pat. No. 4,823,426 issued to Laurence G. Bragga on Apr. 25, 1989 describes a Shoe Sole Cleaning Device comprising a pad which is attachable to the laces of a laced shoe, for rubbing the sole of the opposite shoe of a pair of shoes thereacross for cleaning of the shoe sole. No storage means is disclosed, either for the shoe or for the Bragga cleaning device.

U.S. Pat. No. 4,881,637 issued to Jack Peters et al. on Nov. 21, 1989 describes a Hat And Boot Case providing for the storage and carriage of a pair of western style boots and a wide brim, western type hat. No stand or support is provided for holding a shoe thereon for maintenance or cleaning thereof, as provided by the present invention.

U.S. Pat. No. 5,193,671 issued to Claire A. Patterson on Mar. 16, 1993 describes a Shoe Storage Box With Complementary Supporting Box That Also Functions As A Shoe Storage Container And A Shoe Display Container. The boxes are each formed from a single sheet of material (e. g., cardboard or the like), unlike the present box, and are accordingly inexpensive and disposable. As such, they are structurally unsuitable for the support of a shoe for maintenance or cleaning, and no provision is made for such, as provided by the present shoe maintenance and storage box.

U.S. Pat. No. 5,228,547 issued to Eddie B. Yoo on Jul. 20, 1993 describes a Golf Accessory Bag formed of a flexible fabric material or the like, and providing for the carriage and storage of a pair of golf shoes therein. The need for such a device has been noted above, but the relatively pliable and flexible Yoo bag does not provide support for a shoe or shoes for maintenance and cleaning thereof, as provided by the present box. Other differences are also noted between the Yoo container and the present box.

U.S. Pat. No. 5,269,408 issued to Jon D. Otis et al. on Dec. 14, 1993 describes a Hang-Up Display Box For Shoes wherein the box has no lid to conceal or enclose the shoes, in order to display the shoes. A back wall of the box includes a hole therein providing for hanging the box on a hook for display. The device is relatively lightly constructed, and is not suitable for the support of a shoe for maintenance or cleaning, and further no storage is provided for other articles, as provided by the present shoe maintenance and storage box.

Finally, Swedish Patent Publication No. 14,930 to J. P. Strand and published on Oct. 8, 1901 describes a shoe blacking (polishing) stand including a shoe holding fixture formed on the inner side of a hinged lid. The fixture is exposed when the lid is opened. Other articles (polish, etc.) are apparently contained on a sliding drawer accessible when the lid is opened. The fixture does not provide the depth needed to hold a shoe inverted thereon for working on the sole thereof, as provided by the shoe holder of the present shoe maintenance and storage box.

None of the above noted patents, taken either singly or in combination, are seen to disclose the specific arrangement of concepts disclosed by the present invention.

SUMMARY OF THE INVENTION

By the present invention, an improved shoe maintenance and storage box is disclosed.

Accordingly, one of the objects of the present invention is to provide an improved shoe maintenance and storage box which is in the form of a rectangular solid with opposite maintenance and storage portion surfaces and four side walls therebetween.

Another of the objects of the present invention is to provide an improved shoe maintenance and storage box which has separable maintenance and storage portions, with the side walls of the maintenance portion being substantially lower than the side walls of the storage portion.

Yet another of the objects of the present invention is to provide an improved maintenance and storage box which maintenance portion includes a generally centrally mounted shoe holder, which holder is raised above the upper edges of the maintenance portion side walls and which is adapted to hold a shoe in either an upright or inverted position for maintenance and cleaning thereof.

Still another of the objects of the present invention is to provide an improved shoe maintenance and storage box which maintenance and storage portions include space for the storage of one shoe to each side of the centrally located shoe holder, when the box is closed.

A further object of the present invention is to provide an improved shoe maintenance and storage box which includes a shelf therein, adapted for the storage and carriage of various shoe maintenance and cleaning articles therein.

An additional object of the present invention is to provide an improved shoe maintenance and storage box which may include cross ventilation means, non-skid means on the base portion, and handle means on one side wall thereof.

Another object of the present invention is to provide an improved shoe maintenance and storage box which may be formed from wood, plastic, or other materials, as desired.

A final object of the present invention is to provide an improved shoe maintenance and storage box for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
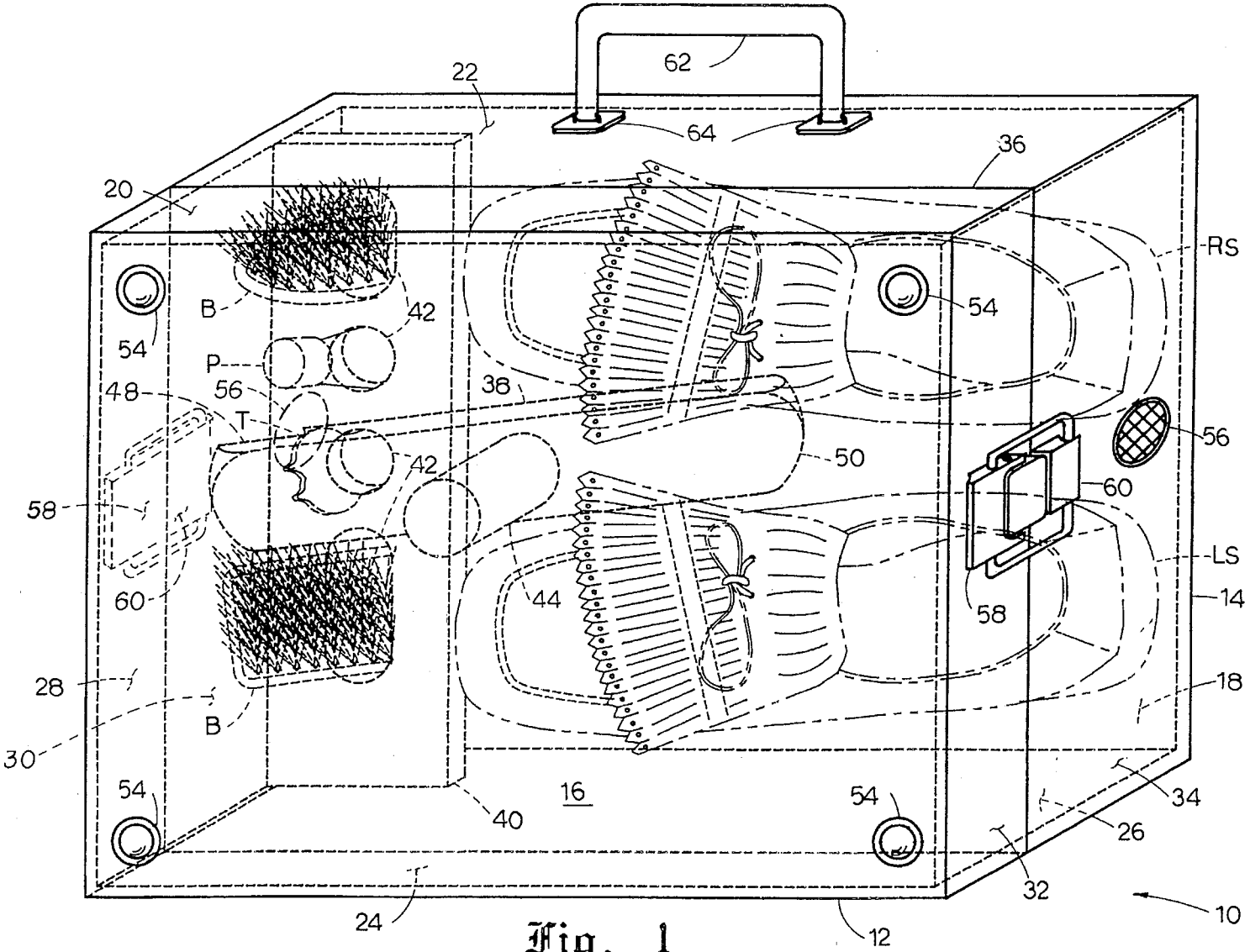
FIG. 1 is a top perspective view of the present shoe maintenance and storage box, with the internal components, shoes, and maintenance and cleaning equipment therein shown in broken lines.

Referring now particularly to figure i of the drawings, the present invention will be seen to relate to a shoe maintenance and storage box 10, providing for the storage of a single pair of shoes therein when closed, and opening to provide a shoe holder for the holding of a shoe thereon for shoe maintenance and/or cleaning. The box 10 may be formed in the general configuration of a rectangular solid, with the box 10 being separable into a maintenance portion 12 and a storage portion 14. Each is generally similarly configured, with the maintenance and storage portions 12 and 14 each respectively having a base wall 16 and 18, and respective first through fourth peripheral walls comprising a first side wall 20 and 22, opposite second side wall 24 and 26, first end wall 28 and 30, and opposite second end wall 32 and 34. Similar peripheral wall pairs for each portion 12 and 14, e.g., maintenance portion 12 and storage portion 14, first side walls 20 and 22, are coplanar with abutting edges, although a lip or flange 35 as shown in FIGS. 2 and 3 may be provided for registry between the two.

Figure 2:
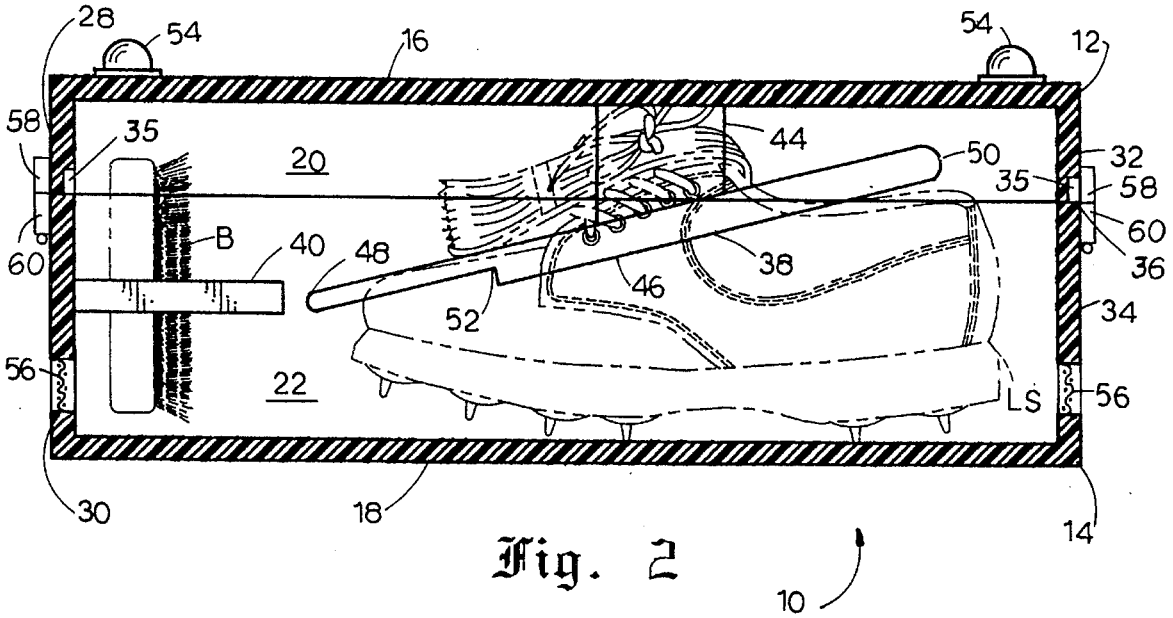
FIG. 2 is a left side view in section of the present shoe maintenance and storage box, showing its features and the arrangement of articles stored therein when the box is closed.
Figure 3:
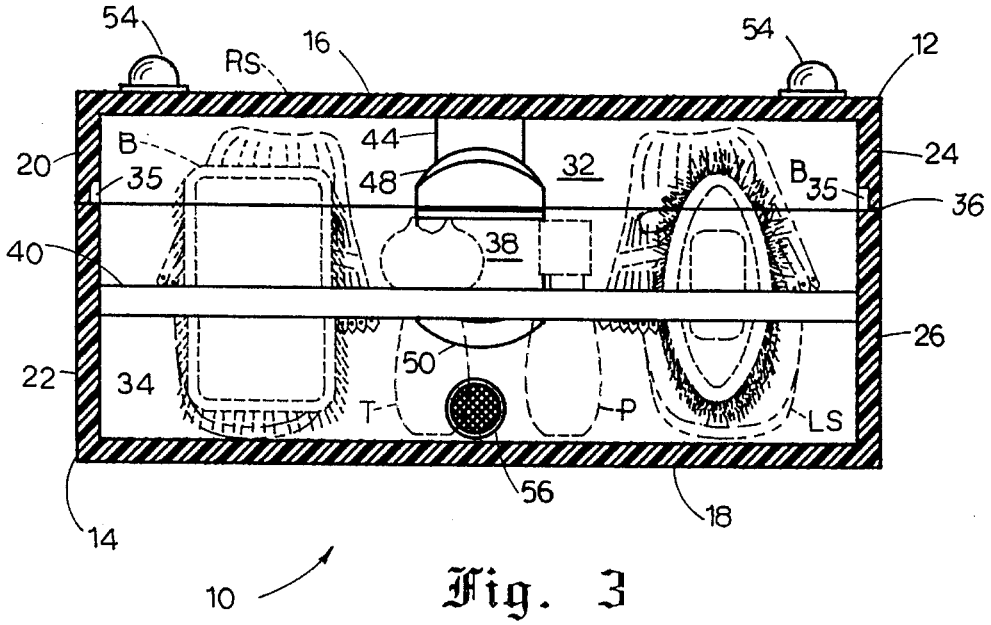
FIG. 3 is a front view in section, with the left end of the box of FIG. 2 being removed.

FIGS. 2 and 3 provide cross sectional views respectively across the length and width of the assembled box 10, showing the storage of a pair of shoes and various other articles therein. It will be noted that the peripheral walls of the inverted upper maintenance portion 12 are relatively shorter than the peripheral walls of the lower storage portion 14. The unequal height of the respective walls of the maintenance and storage portions 12 and 14 provides advantages discussed further below. Normally, when the present box 10 is being used for storage of a pair of shoes, it will be oriented as shown in FIGS. 2 and 3, with the maintenance portion 12 inverted and resting atop the storage portion 14.

Each of the coplanar pairs of side and end walls 20/22, 24/26, 28/30, and 32/34 meet at a common peripheral edge 36 when the two portions 12 and 14 are secured together to form a closed box 10. The edge 36 does not bisect the closed box 10, but is closer to the maintenance base 16 than to the storage base 18, with the storage portion side and end walls 22, 26, 30, and 34 being taller or higher than the maintenance portion side and end walls 20, 24, 28, and 32. This provides sufficient depth for the storage portion 14 to hold securely a pair of shoes and other articles therein.

The maintenance portion 12 includes a shoe holder 38 extending from the base wall 16 between the maintenance portion peripheral walls 20, 24, 28, and 32. The side elevation views in section of FIGS. 2 and 3 show the peripheral wall edge 36 to define a plane through the closed box assembly 10, and the shoe holder 38 to extend from the maintenance base 16, through or past the plane of the wall edge 36, to extend at least partially into the storage section 14 when the maintenance and storage portions 12 and 14 are assembled to form a closed box 10. This construction provides for ease of access to the shoe holder 38 when the maintenance portion 12 is removed from the storage portion 14 and used for shoe maintenance and cleaning, as shown in FIG. 5.

Figure 4:
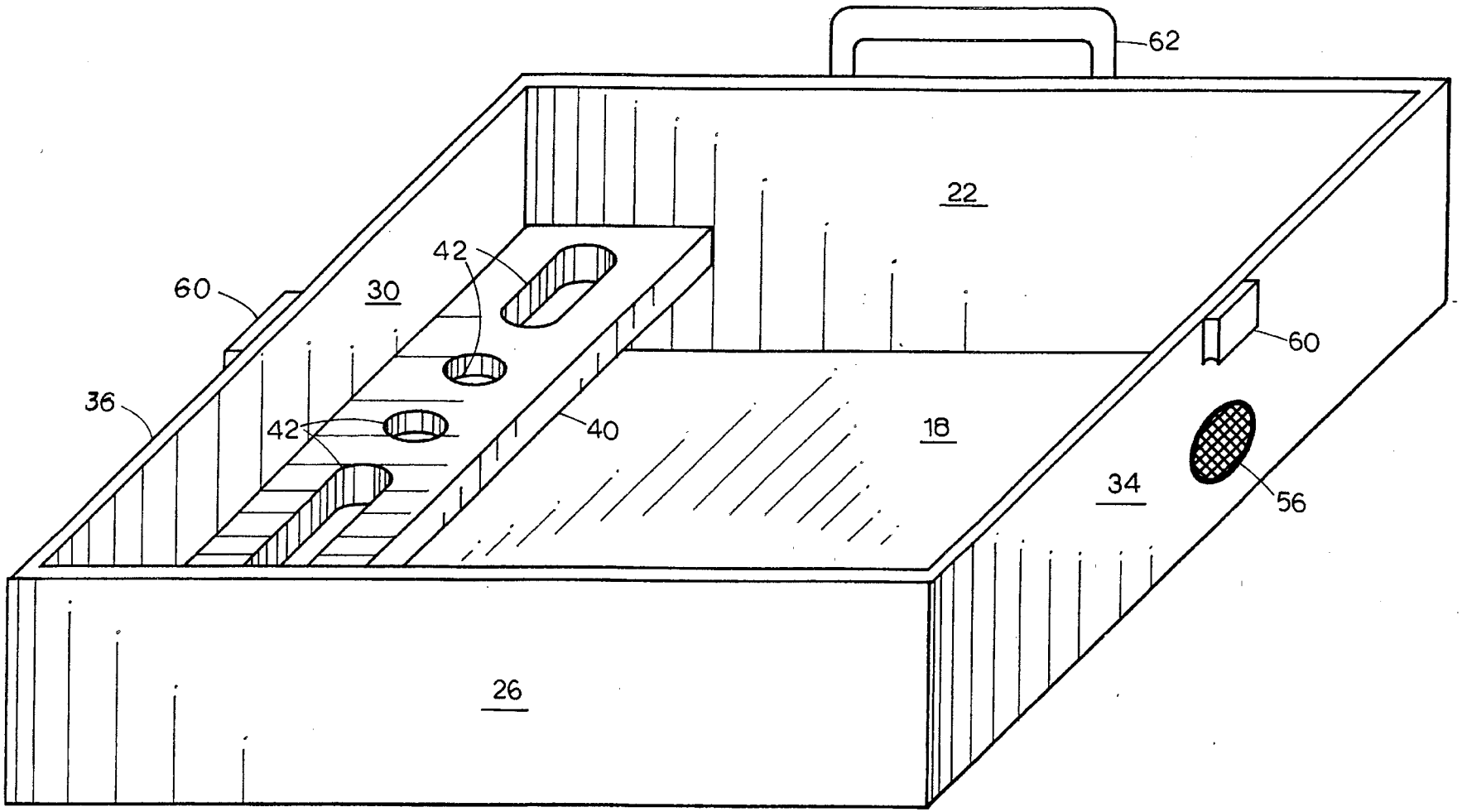
FIG. 4 is a perspective view showing the interior of the storage portion of the box, and the article storage shelf therein.

A shelf 40 is provided in the storage section 14, extending between the two opposite side walls 22 and 26 and against the first end wall 30. This shelf 40 includes a plurality of holes 42 (FIGS. 1 & 4) therein, adapted to hold various shoe maintenance/cleaning articles (e. g., brushes B, polish bottles P, a spike tool(s) T, etc.). Preferably, the closed box assembly 10 is sufficiently low that such articles are captured between the two base walls 16 and 18, and cannot slip out of their individual retaining holes 42.

Figure 5:
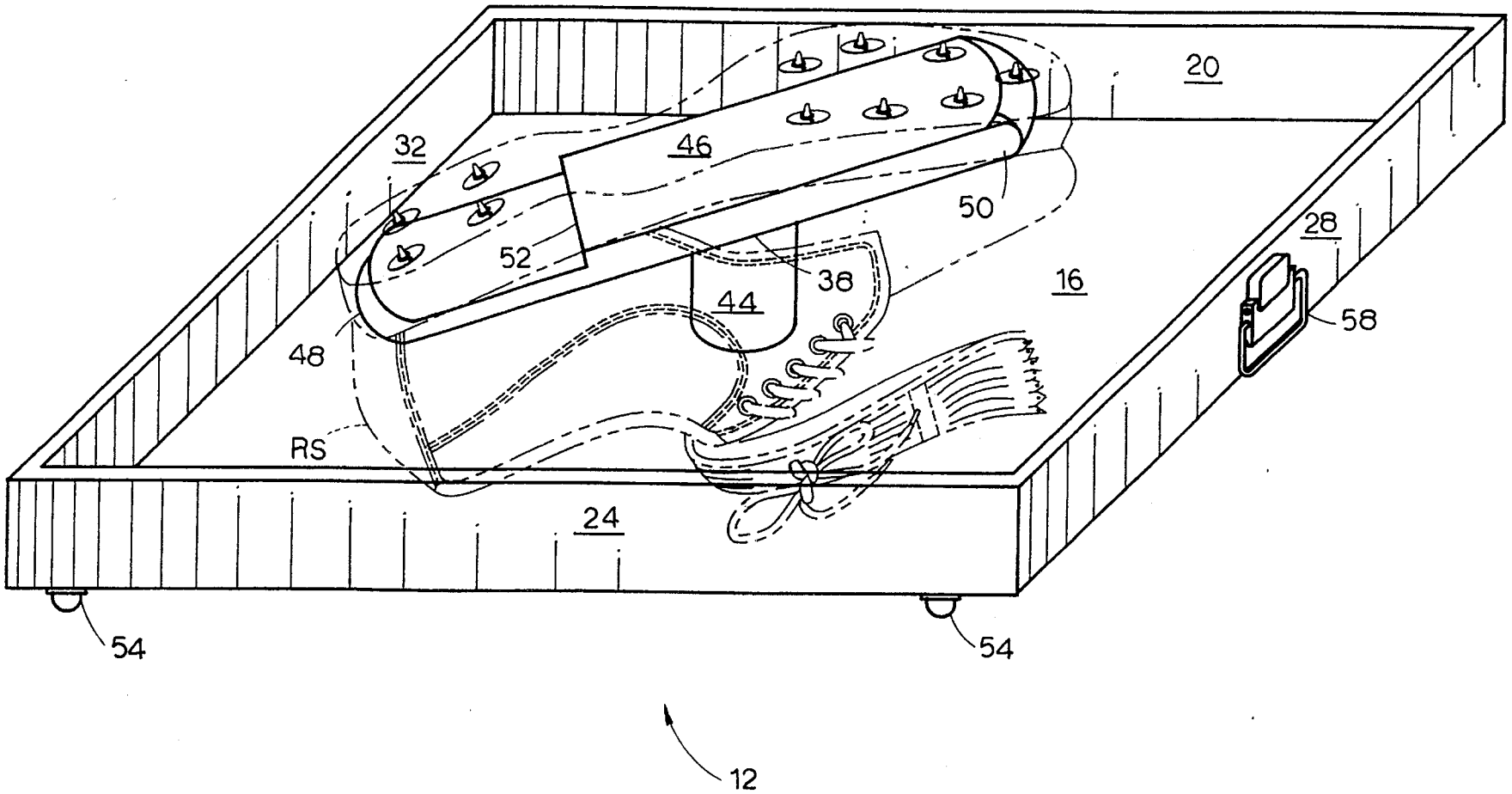
FIG. 5 is a perspective view of the inverted maintenance portion of the box, showing the positioning of a shoe (in phantom lines) on the shoe holder for maintenance or cleaning of the shoe.

FIG. 5 provides a perspective view of the shoe maintenance portion 12 of the present box 10, in use. The shoe holder portion 38 comprises a support column 44 extending from the inner surface of the maintenance portion base wall 16. Column 44 is preferably centrally positioned relative to the opposite first and second side walls 20 and 24 of the maintenance portion 12, to provide space on either side thereof for a left shoe LS and right shoe RS, as shown in FIGS. 1 and 3. (The left and right shoes LS and RS are reversed in FIG. 3, due to the direction of the view.) However, the shoe holder column 44 may be offset closer to one end wall than the other (e. g, closer to the second end wall 32 than to the opposite first end wall 28 of the maintenance portion 12), in order to provide clearance for the storage portion shelf 40 when the two components 12 and 14 are assembled to form the closed box 10.

A shoe holder plate 46 is secured to the end of the column 44, which plate 46 provides for the holding of a shoe thereon. The plate 46 has a heel end 48 and an opposite toe end 50. Either the heel end 48 or the toe end 50 may be placed closer to the maintenance portion base wall 16 than the opposite end 50/48, as shown respectively in FIGS. 5 and 2, in order to angle a shoe placed thereon for greater convenience while working on the shoe. The heel end 48 includes a step 52 therein, serving to catch the heel of a shoe thereon, to preclude slippage of the shoe. It will be seen that the laterally symmetrical nature of the shoe plate allows either a left or a right shoe to be placed thereon with equal ease. A shoe may be installed inverted over the shoe plate, for maintenance of the sole and heel (replacement or repair of spikes, etc.) or may be placed upright atop the shoe plate for cleaning and polishing the upper portion of the shoe.

The maintenance portion 12 of the box 10 may also include a plurality of friction pads or feet 54 on the exterior of the base wall 16 thereof, in order to preclude slippage of the maintenance portion 12 when it is being used for work on a shoe, as shown in FIG. 5. The storage portion 14 of the box 10 preferably includes at least two vents 56 disposed in opposite sides or ends, e. g., the opposite ends 30 and 34 of the storage portion 14 as shown in FIG. 2, in order to provide cross flow ventilation through the entire closed box 10.

Closure means for the box 10 may comprise oppositely disposed latches, such as the over center latches 58 and cooperating catches 60 respectively installed on the maintenance portion 12 and the storage portion 14 of the box 10. A handle, such as the generally U-shaped handle 62 secured by means of pivots or pins 64, may be secured to the box 10 (e.g., to one of the sides 22 or 26 of the storage portion 14)

to provide for ease of carriage and transport of the closed box 10.

In summary, the present shoe maintenance and storage box 10 will be seen to provide greater convenience for those needing to carry and/or maintain a pair of shoes for whatever purpose. While the present maintenance/storage box 10 is particularly suitable for the maintenance and storage of golf shoes, providing for work on the spikes or cleats thereof as well as other maintenance and cleaning, it will be seen that the present box 10 is not limited to use only with golf shoes or any particular type of specialized shoes, for that matter, but may be used for the carriage, storage, maintenance, and cleaning of virtually any type of shoes or footwear as required or desired.

A pair of shoes may be stored and carried in the box 10 to the location needed (golf course, etc.), and the shoes donned for use at that point, rather than the user being required to wear the specialized shoes, with their features which may not be suitable outside their intended environment, to the point of use. Standard "street" or other shoes may be stored in the box 10 while the specialized or other shoes are in use and the user is engaged in the activity requiring use of the specialized or other shoes. At the end of the activity (e. g., round of golf), the box may be opened and the maintenance portion inverted to access the shoe holder portion thereof. The specialized shoes may be placed inverted (one at a time) upon the shoe holder of the maintenance portion of the box, for cleaning of or work on the spikes, etc., or placed upright atop the holder plate for cleaning and/or polishing of the upper portion of the shoe. The inside of the maintenance portion, with its relatively low walls, serves as a tray to catch any dirt and debris removed from the shoes during cleaning. The various tools and equipment required for such work are readily at hand due to the retaining shelf provided in the present box.

When the shoes are ready for storage again, they may be placed in the storage portion of the box, the maintenance portion may be emptied of debris in a convenient trash receptacle, and inverted over the storage portion and secured thereto by means of the latches provided. The closed box, with shoes and equipment contained therein, may then be carried to a place of storage, with the shoes therein ready for the next use. The cross flow ventilation means in the box assures that unpleasant moisture buildup or other problems will be alleviated, with proper air circulation provided during storage of the box and shoes therein.

The present box 10 may be formed of virtually any suitable material, with wood or plastic being used to form at least the storage portion, maintenance portion, and shoe holder portion of the box 10. Wood has been found to be a very comfortable material for the purposes of the present box 10, and provides an inexpensive, yet durable, construction. Plastic may prove to be advantageous for manufacturing purposes, and/or the molding or forming of certain specialized shapes. Other materials may be used as desired.

It is to be understood that the present invention is not limited to the sole embodiment described above, but encompasses any and all embodiments within the scope of the following claims.

I claim:

1. A shoe maintenance and storage box comprising:

a separable maintenance portion and a storage portion, with said maintenance portion and said storage portion securable together to form a closed box;

said maintenance portion and said storage portion each having a base wall with four corners and first through fourth peripheral walls, with said maintenance portion base wall and said storage portion base wall being oppositely disposed, and said first through fourth peripheral walls of said maintenance portion and said base portion being respectively coplanar when said maintenance portion and said base portion are secured together, and wherein said peripheral walls of said maintenance portion are shorter than said peripheral walls of said storage portion;

a shoe holder mounted on said maintenance portion base wall comprising a laterally symmetrical shoe plate mounted on a non-hinged column extending therefrom and between said maintenance portion's first through fourth peripheral walls, with said maintenance portion's first through fourth peripheral walls having an edge defining a plane, and said shoe holder extending beyond said plane of said edge of said maintenance portion's peripheral walls, whereby either a left or a right shoe can be placed on said laterally symmetrical shoe plate and a shoe can be installed either inverted or upright over said shoe plate;

storage space for footwear on either side of said shoe holder within said shoe maintenance and storage box;

a shelf disposed within said storage portion of said box having a plurality of holes therein with each of said holes providing for the retention of a shoe maintenance and cleaning article therein; and four friction pads extending from the exterior of said maintenance portion base wall and each said friction pad situated proximate to one said corner of said maintenance portion base wall to preclude slippage of the maintenance portion when a shoe is being worked on.

2. The shoe maintenance and storage box of claim 1 wherein:

said storage portion's first through fourth peripheral walls respectively comprise a first end wall, oppositely disposed first and second side walls, and a second end wall opposite said first end wall, and said shelf is positioned against said first end wall and extends between said first and second side walls and is parallel to said storage portion's base wall.

3. The shoe maintenance and storage box of claim 1 wherein:

at least said maintenance portion has opposite first and second side walls and opposite first and second end walls, and said shoe holder column and said shoe holder plate are centrally positioned between said first and second side walls and offset closer to said second end wall than to said first end wall.

4. The shoe maintenance and storage box of claim 1 wherein:

said shoe holder plate includes a stepped heel portion thereon adapted for the retention of a shoe heel thereon to preclude slippage of the heel of a shoe placed upon said shoe holder plate.

5. The shoe maintenance and storage box of claim 4 wherein:

said shoe holder plate is disposed at an angle relative to said maintenance portion base wall and includes a toe end opposite said stepped heel portion, with said shoe holder plate's heel portion positioned farther from said maintenance portion base wall than said shoe holder plate's toe end.

6. The shoe maintenance and storage box of claim 4 wherein:

said shoe holder plate is disposed at an angle relative to said maintenance portion's base wall and includes a toe end opposite said stepped heel portion, with said shoe holder plate's heel portion positioned closer to said maintenance portion's base wall than said shoe holder plate toe end.

7. The shoe maintenance and storage box of claim 1 wherein:

said maintenance portion and said storage portion each respectively include at least a first end wall and a second end wall disposed opposite said first end wall, with said first end walls of said maintenance portion and said storage portion and said second end walls of said maintenance portion and said storage portion each respectively including cooperating latch means thereon providing for securing of said maintenance portion to said storage portion to form said closed box.

8. The shoe maintenance and storage box of claim 7 wherein:

each said latch means comprises an over center latch and cooperating catch.

9. The shoe maintenance and storage box of claim 1 wherein:

at least said maintenance portion includes at least a first end wall and a second end wall disposed opposite said first end wall, with at least said maintenance portion's first end wall and opposite second end wall each including at least one vent disposed therethrough to provide cross flow ventilation through said box.

10. The shoe maintenance and storage box of claim 1, wherein:

a U-shaped handle is pivotally secured to one of said storage portion side walls.

11. The shoe maintenance and storage box of claim 1 wherein:

at least said storage portion, said maintenance portion, and said shoe holder are formed of wood.

12. The shoe maintenance and storage box of claim 1 wherein:

at least said storage portion, said maintenance portion, and said shoe holder are formed of plastic.

13. The shoe maintenance and storage box carrier of claim 1 wherein:

said shelf adapted in height from said base wall of said storage portion and adapted in shape of each of said plurality of holes to hold shoe maintenance and cleaning articles selected from the group consisting of brushes, polish bottles, spike tools, and mixtures thereof.

14. The shoe maintenance and storage box carrier of claim wherein:

said edge of each of said maintenance portion's first through fourth peripheral walls and said edge of each said storage portion's first through fourth peripheral walls form a lip, whereby said lip provides for registry between said edges of said maintenance portion and said storage portion.

* * * * *